US007210278B2

(12) United States Patent
Chiu Chen

(10) Patent No.: US 7,210,278 B2
(45) Date of Patent: May 1, 2007

(54) DETECTING AND PROTECTING DEVICE OF A SHRINK FILM MACHINE

(75) Inventor: Tuan-Mei Chiu Chen, Chia Yi Hsien (TW)

(73) Assignee: Tien Heng Machniery Co., Ltd., Chia Yi Hsien (TW)

( * ) Notice: Subject to any disclaimer, the term of this patent is extended or adjusted under 35 U.S.C. 154(b) by 0 days.

(21) Appl. No.: 11/220,560

(22) Filed: Sep. 8, 2005

(65) Prior Publication Data

US 2007/0051075 A1 Mar. 8, 2007

(51) Int. Cl.
*B65B 9/06* (2006.01)
*B65B 57/12* (2006.01)

(52) U.S. Cl. ..... 53/64; 53/74; 53/567; 53/576

(58) Field of Classification Search ..... 53/567
See application file for complete search history.

(56) References Cited

U.S. PATENT DOCUMENTS 4,050,219 A * 9/1977 Higgins ..... 53/567
4,063,401 A * 12/1977 Higgins ..... 53/567
4,409,774 A * 10/1983 Hannen ..... 53/77
4,473,980 A * 10/1984 Foster ..... 53/567
6,381,929 B1 * 5/2002 Chen ..... 53/567

* cited by examiner

*Primary Examiner*—John Sipos
(74) *Attorney, Agent, or Firm*—Rosenberg, Klein & Lee

(57) ABSTRACT

A detecting and protecting device includes detecting devices, and an ultrasonic sensor; the detecting devices are connected to respective ones of expanding assemblies of a shrink film machine, and each include a seat behind a supporting rod of a corresponding expanding assembly, a movable rod passed through the seat and projecting below the supporting rod, a stopping board pivoted to one end of the movable rod, a shading block joined to one end of the stopping board, and a sensor positioned on the movable rod and normally shaded by the shading block; if the stopping board comes into contact with goods while a shrink film is being lowered, it will tilt, and the shading block will no longer shade the sensor; the ultrasonic sensor is used for measuring height of the goods such that sealing and cutting action will start immediately after the film encompasses the goods.

3 Claims, 10 Drawing Sheets

DETECTING AND PROTECTING DEVICE OF A SHRINK FILM MACHINE

BACKGROUND OF THE INVENTION

1. Field of the Invention

The present invention relates to a detecting and protecting device of a shrink film machine, more particularly one, which includes a sensor, and a shading block normally shading the sensor; the shading block will be displaced, and no longer shade the sensor if the bag expanding device comes into contact with the goods during downward movement thereof owing to incorrect position of the goods.

2. Brief Description of the Prior Art

Referring to FIG. 11, a currently available shrink film machine includes a frame 1, a bag feeding device 2, a bag sealing device 3, a bag sucking device 4, and a bag expanding device 5. The bag feeding device 2 is used for feeding continuous bags. The bag sucking device 4 has a sucking unit, which will suck an opening end of the bag, and which will move so as to open the bag after the opening end has been opened. The bag expanding device 5 has several supporting rods 51. The bag will be positioned around the supporting rods 51 after the bag is completely opened. Next, the supporting rods 51 are moved such that the bag is further expanded to the largest size possible. And, an up and down movable support for the supporting rods 51 moves downwards with the supporting rods 51 gradually releasing the bag so that the bag is wrapped around a pallet and goods on the pallet.

The inventor of the present invention develops an improvement on a cold shrink film wrapping machine, which includes a frame, a bag feeding device, a bag sealing device, a bag sucking device, and a bag expanding device. The bag feeding device and the bag sealing device are positioned on top of the frame, and are respectively used for feeding continuous bags, and for sealing and cutting the bags. A conveying mechanism is positioned right under and across the frame for conveying a pallet and goods on the pallet through the frame.

The bag sucking device includes left and right bag-sucking assemblies, which have the same structure, each having first and second air-sucking units positioned around respective ones of two opposed slide rods. Each of the slide rods of the left and the right bag-sucking assemblies are connected to pulley assemblies at two ends such that they are supported on guide rods of the upper end of the frame. Tail ends of the slide rods of the right bag-sucking assembly are securely joined to a first end of an output shaft of an air cylinder, which is secured on the frame. And, the left and the right bag-sucking assemblies are connected to chains such that they can be moved away from each other, and they can be moved closer to each other. Furthermore, each of the air-sucking units has an air cylinder of an air cylinder assembly securely connected to a rear end thereof; the air cylinder has a swing arm pivoted to the other end of an output shaft thereof, which swing arm is pivoted to the air-sucking unit at one end, and securely connected to a pressing rod at the other end thereof; thus, when the air cylinder is working, it will make the pressing rod swing inwards.

The bag expanding device includes up and down movable supports, a first left, a second left, a first right, and a second right bag expanding assemblies, which are connected to respective ones of the up and down movable supports; each of the up and down movable supports has a sliding base, which is supported on a rail of the frame of the machine; the up and down movable supports are connected to a power source by means of respective up and down movable chains such that when the power source is activated, each of the up and down movable supports and the respective bag expanding assembly will be moved together. In addition, each of the first left, the second left, the first right, and the second right bag expanding assemblies includes a base, an extension arm, and a bag collecting unit; the bases are secured on respective ones of the up and down movable supports; each of the bases has a motor secured on a lateral side thereof such that the extension arm can be stretched and withdrawn by means of activating the motors; each of the extension arms has an upright support board secured to the other end thereof, which has a through hole on a middle portion, and a rolling shaft held in the through hole thereof. Furthermore, the bag collecting units are respectively positioned on upper ends of the bases, and they each have an air cylinder secured on the corresponding base; each of the cylinders is securely connected to a bag-collecting motor at the other end thereof; each of output shafts of the bag-collecting motors is securely connected to a pressing wheel. Thus, when the air cylinders work to make the bag collecting motors move outside, the pressing wheels will be pressed against the rolling shafts of the upright support boards of the extension arms.

Therefore, after packaging bags are fed, the air-sucking units of the bag-sucking device will suck the packaging bags. After the pressing rods of the air cylinder assembly will be pressed against corners of the packaging bags to make them stay in position, the bags will be completely expanded without the risk of falling off. The bag expanding device will feed a certain length of packaging bag, and the bag will be collected under the support boards by means of the pressing wheels of the bag collecting units. When the extension arms are withdrawn, the bags will be expanded to the largest size possible such that the bags will be positioned around the goods and the pallet when the bag-expanding device is lowered.

The above mentioned shrink film machines have the following disadvantages: Because the shrink film machines aren't equipped with any detector, if the goods are tilted or improperly positioned, the bag expanding assemblies will hit the goods, causing damage to themselves and the goods. And, the shrink film machines aren't equipped with any sensor for measuring the height of the goods.

SUMMARY OF THE INVENTION

It is a main object of the invention to provide a detecting and protecting device to a shrink film machine to overcome the above-mentioned problem. The detecting and protecting device of the invention includes several detecting devices, and an ultrasonic sensor. The detecting devices are connected to respective ones of expanding assemblies of a shrink film machine, and each include a support seat behind a supporting rod of a corresponding expanding assembly, a seat positioned behind the supporting rod, a movable rod passed through the seat and projecting below the supporting rod, a stopping board pivoted to one end of the movable rod, a shading block joined to one end of the stopping board, and a sensor positioned on the movable rod and normally shaded by the shading block. If the stopping board comes into contact with goods while a shrink film is being lowered, it will tilt, and the shading block will no longer shade the sensor. The ultrasonic sensor is used for measuring height of the goods such that sealing and cutting action will start immediately after the shrink film is lowered to such a position as to encompasses the goods.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
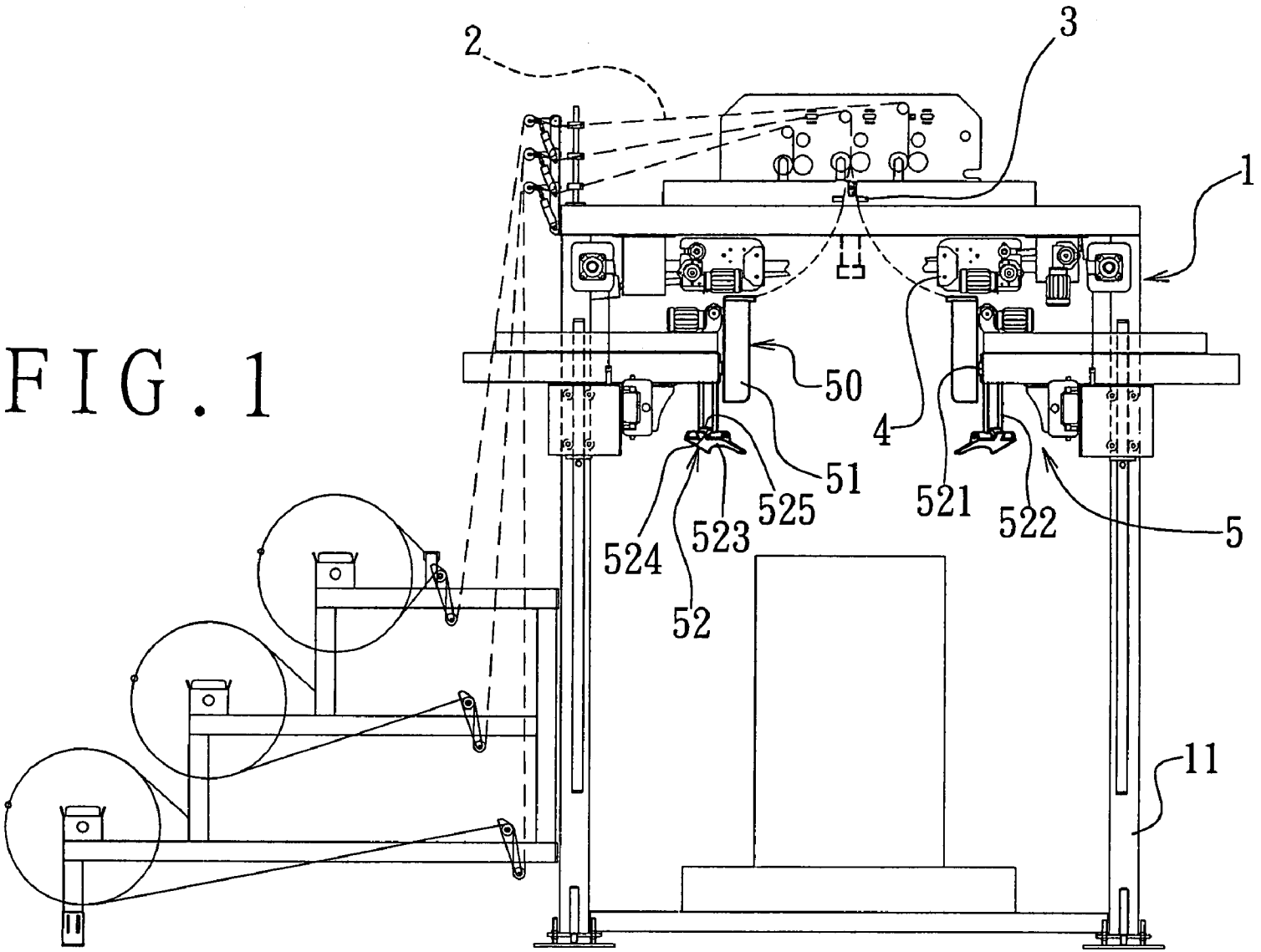
FIG. 1 is a side view of the shrink film machine of the invention.

Referring to FIG. 1, a preferred embodiment of a shrink film machine of the present invention includes a frame 1, a bag feeding device 2, a bag sealing device 3, a bag sucking device 4, a bag expanding device 5, several detecting devices 52, and an ultrasonic sensor 55; the devices 2 to 5 have the same structure and usage as those of the conventional shrink film machine as described in Background therefore they won't be detailed again herein.

The bag expanding device 5 includes several movable expanding assemblies 50, each of which includes a supporting rod 51. The detecting devices 52 are connected to respective ones of the movable expanding assemblies 50, below the supporting rods 51, and each include a support seat 521, a movable rod 522, a stopping board 523, a shading block 524, and a sensor 525; the support seat 521 is positioned behind the supporting rod 51, and the movable rod 522 is passed through the support seat 521, and projects below the supporting rod 51; the stopping board 523 is pivoted to one end of the movable rod 522, the shading block 524 is joined to one end of the stopping board 523; the sensor 525 is positioned on a portion of the movable rod 522 that is faced with the shading block 524 of the stopping board 523 such that the sensor 525 is normally shaded by the shading block 524.

Figure 2:
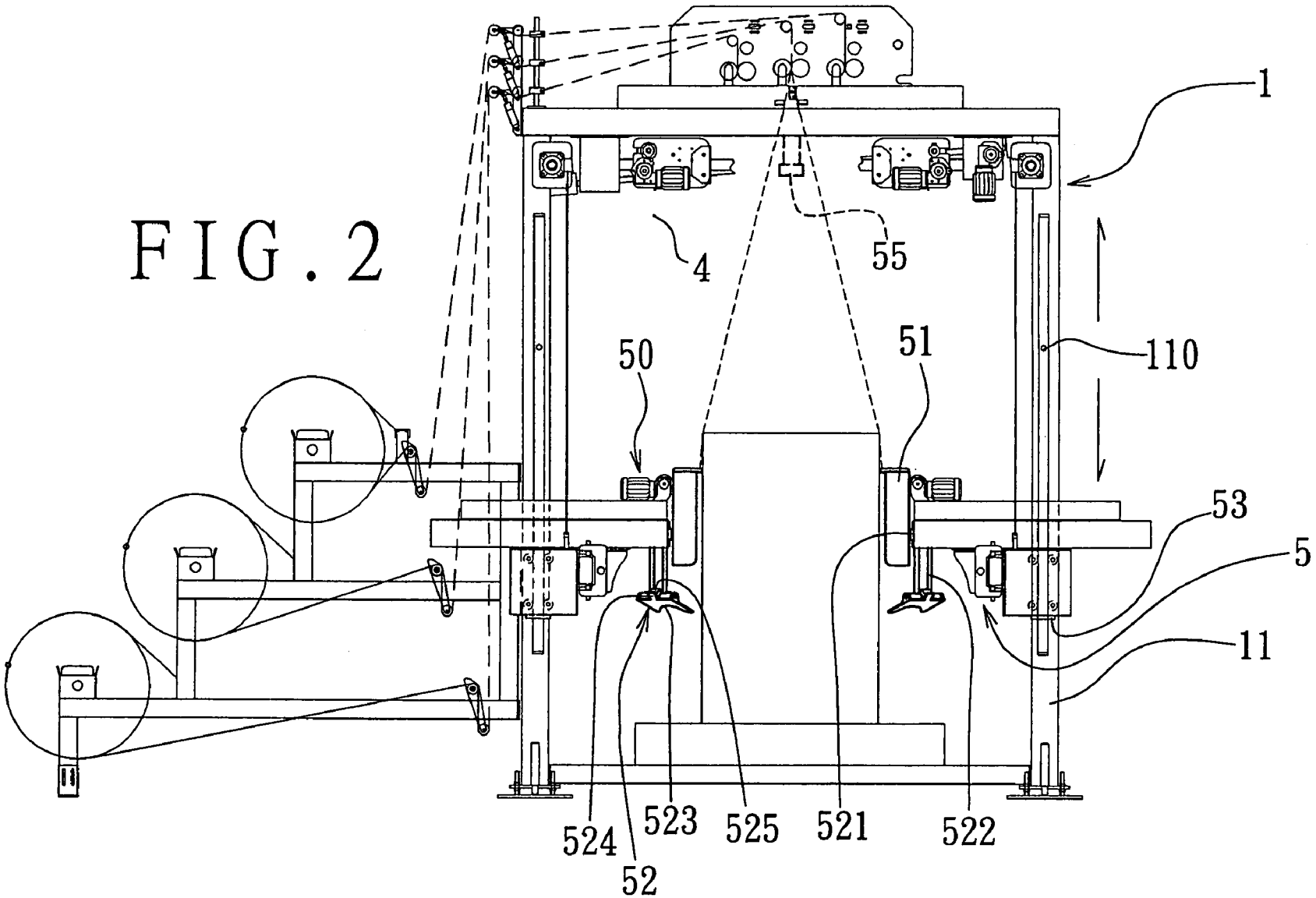
FIG. 2 is a side view of the present shrink film machine, with the bag expanding device working under normal conditions.
Figure 3:
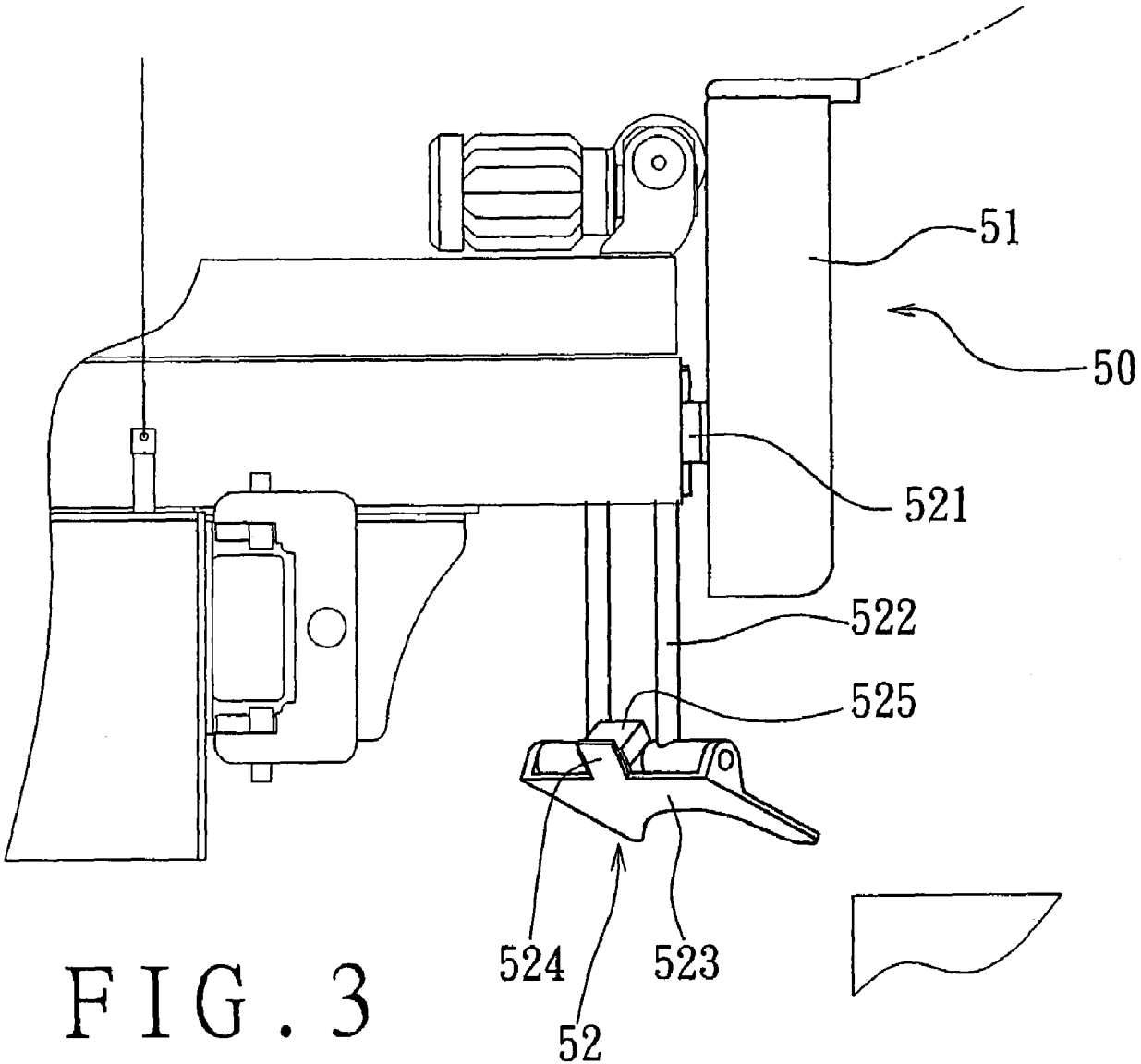
FIG. 3 is a view of the detecting device under normal conditions.
Figure 4:
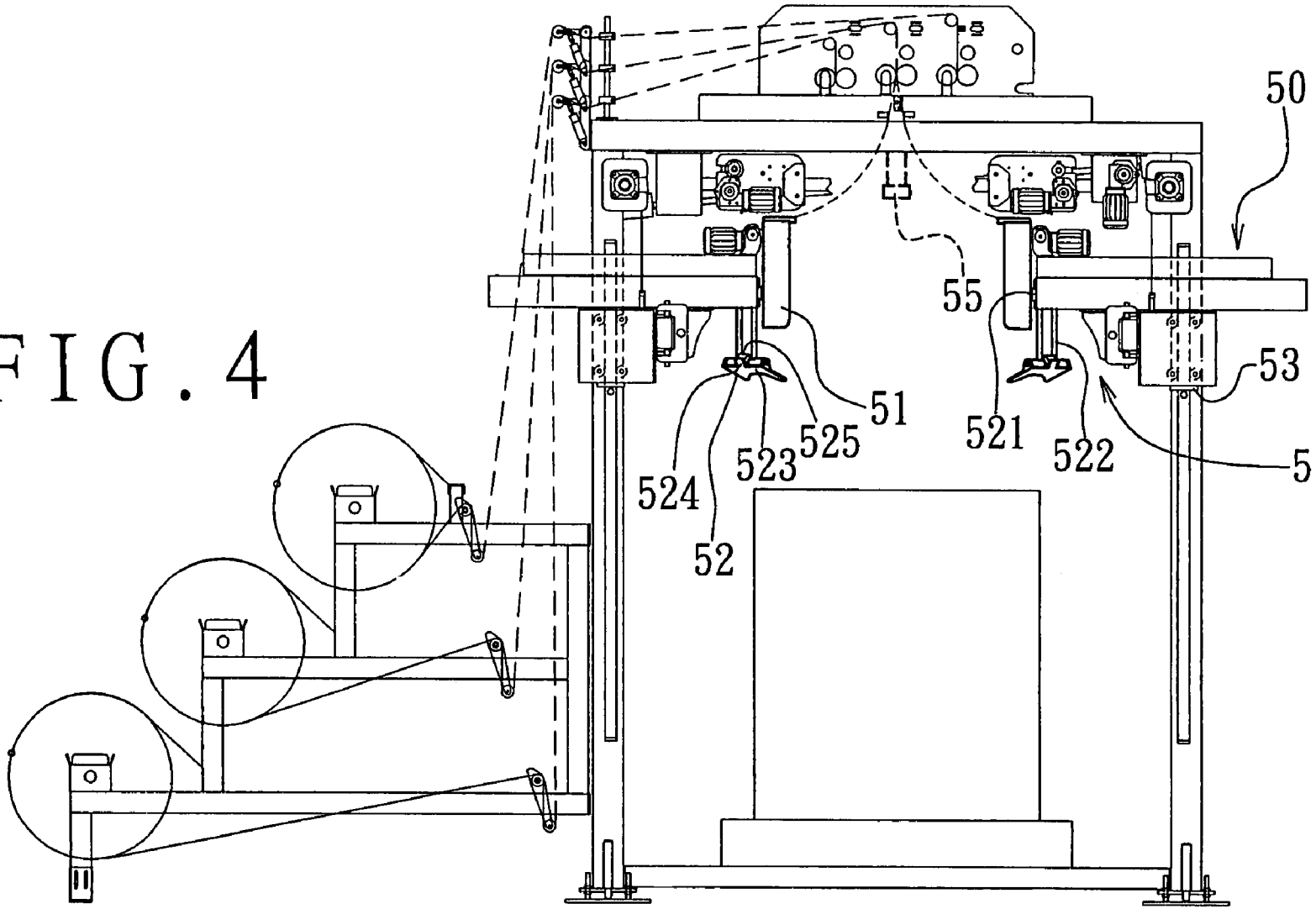
FIG. 4 is a side view of the present machine taken when the bag expanding device fails to expand a bag sufficiently.
Figure 5:
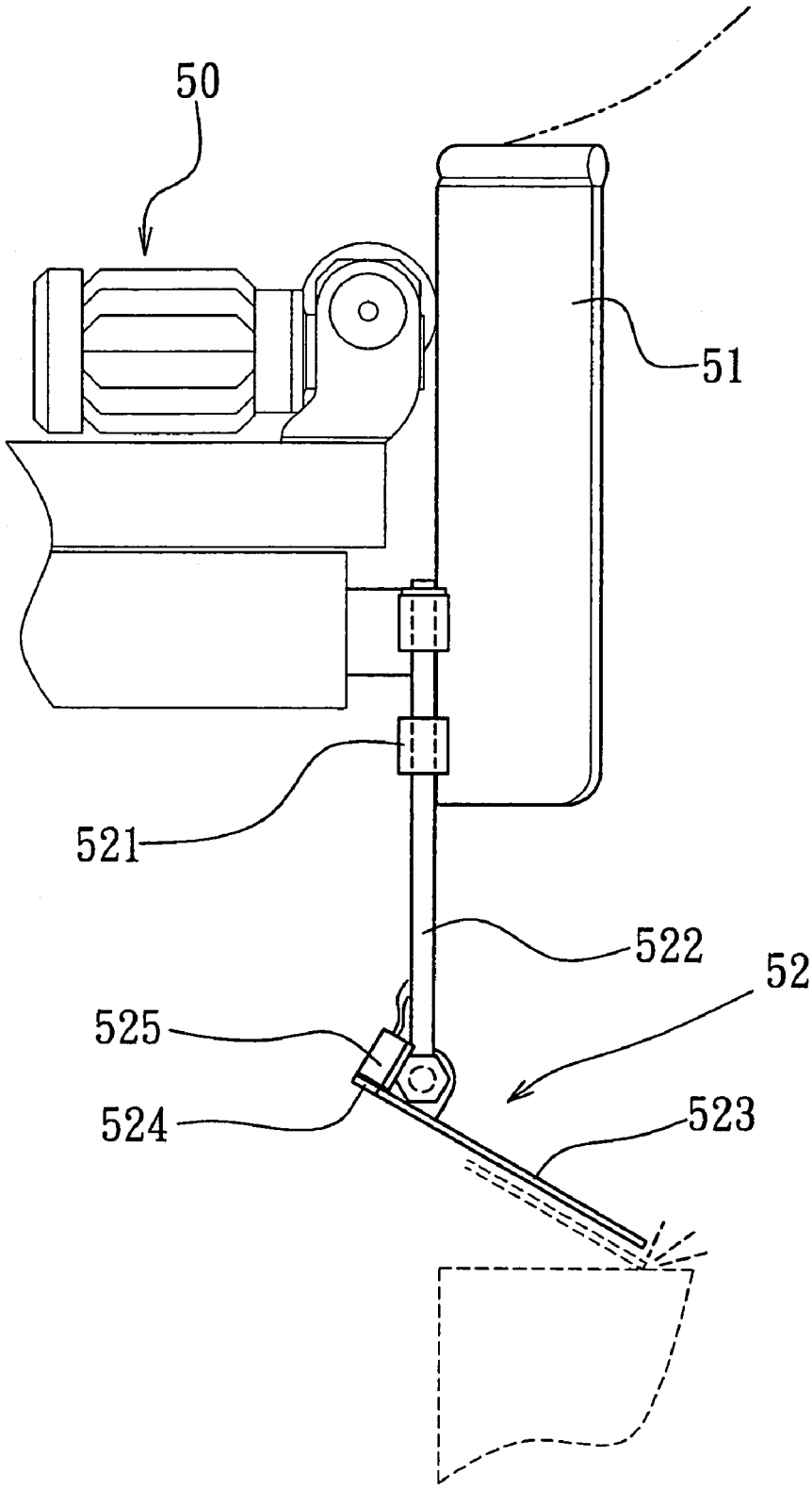
FIG. 5 is a view of the stopping board of the detecting device getting into contact with the goods to be wrapped in a shrink film (1)
Figure 6:
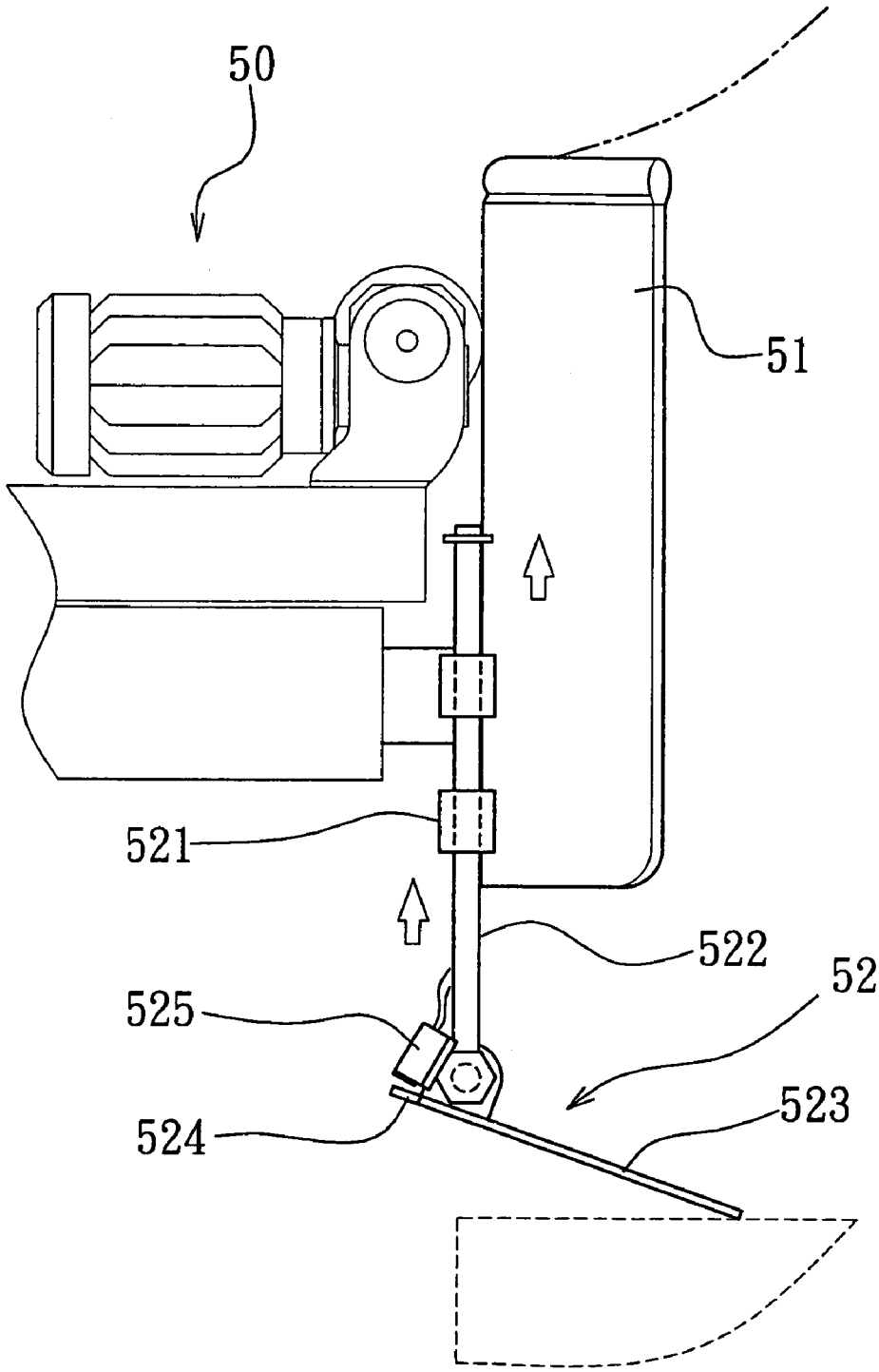
FIG. 6 is a view of the stopping board getting into contact with the goods (2)
Figure 7:
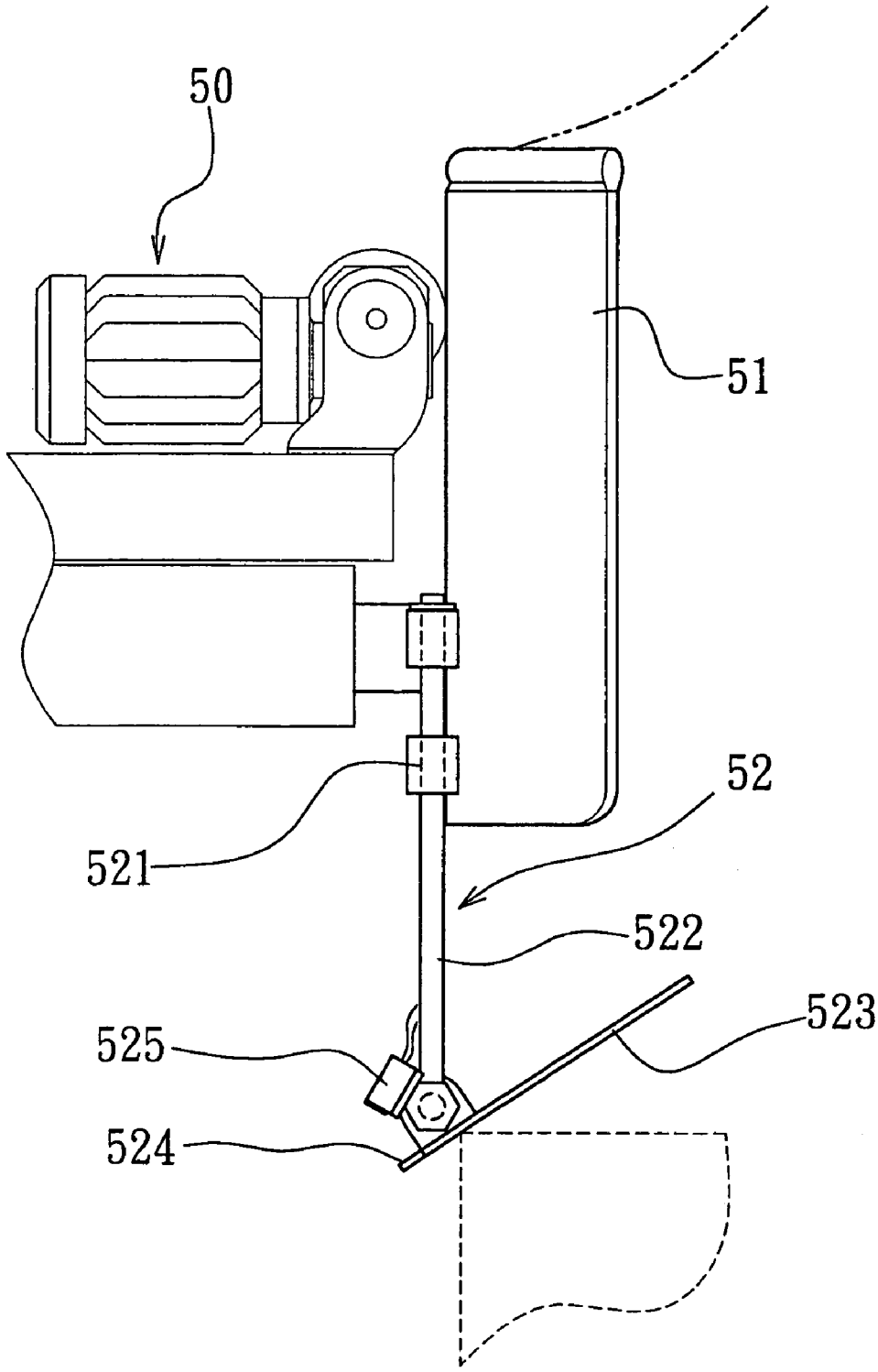
FIG. 7 is a view of the stopping board getting into contact with the goods (3)

Referring to FIGS. 2 and 3, under normal conditions, first the supporting rods 51 of the movable expanding assemblies 50 of the bag expanding device 5 will move upwards, and prop the shrink film in the bag sucking device 4. Then, the movable expanding assemblies 50 will moves backwards to expand the shrink film to such a width that the shrink film can be wrapped around the goods. And, the shrink film is moved downwards and positioned around the goods.

Referring to FIGS. 4 to 7, if the goods to be wrapped with shrink film tilt or aren't positioned in the correct place, the stopping boards 523 of the detecting device 52 will come into contact with the goods during the course of the movable expanding assemblies 50 moving downwards to place the shrink film around the goods. Therefore, the stopping boards 523 pivots to a tilting position, and the shading block 524 no longer shades the sensor 525, and in turns the sensor 525 sends out a signal to a control system. Consequently, the control system makes the bag expanding device 5 as well as the other mechanisms of the machine stop. There will be several seconds between tilting of the stopping boards 523 and the complete stoppage of the bag expanding device 5 and the other mechanisms of the machine, during which several seconds the movable expanding assemblies 50 of the bag expanding device 5 will still move downwards, and the movable rods 522 will be slightly displaced to act as a buffer, thus preventing the goods and the whole machine from getting damaged.

Figure 8:
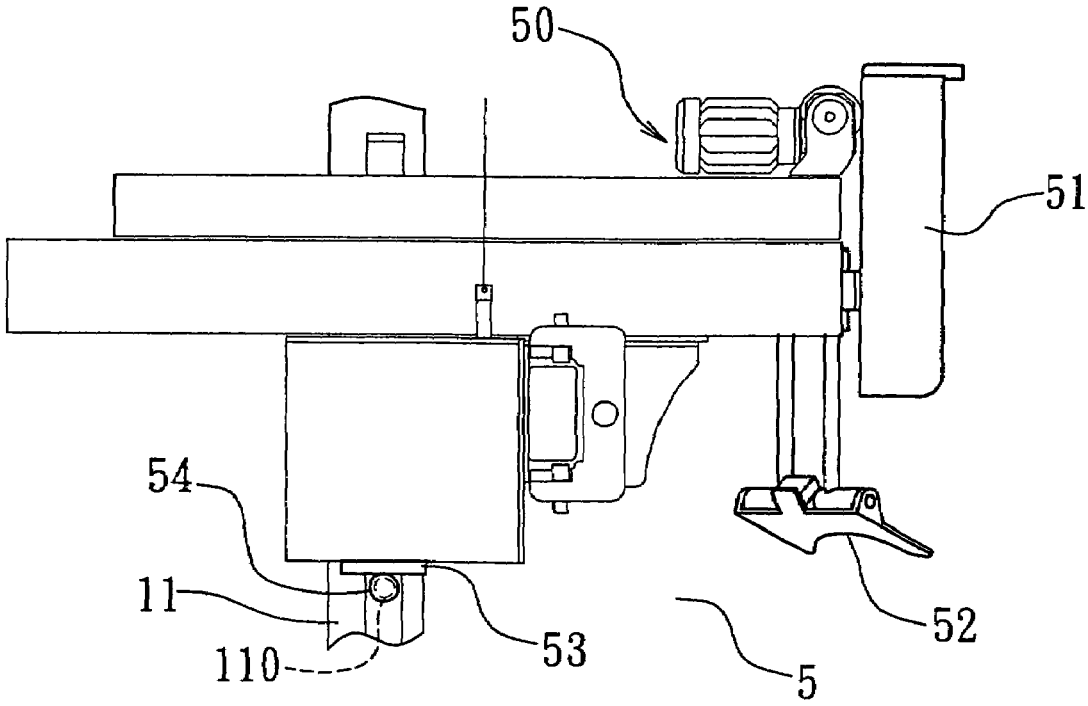
FIG. 8 is a partial view of the present invention, showing the position of the polyurethane pad.
Figure 9:
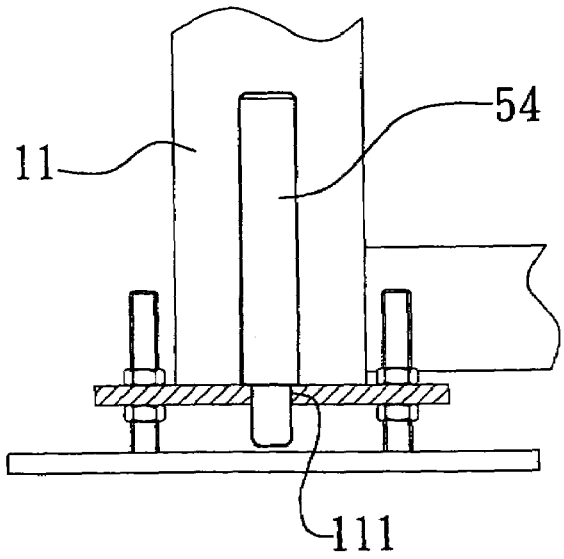
FIG. 9 is a partial view of the present invention, with a pin being stored in a holding cavity.

Referring to FIGS. 8 and 9, the movable expanding assemblies 50 of the bag expanding device 5 each have a polyurethane pad 53 on a lower side thereof, and the frame 1 has support posts 11, each of which has a through hole 110. Therefore, when the machine isn't in use or when the machine needs to be repaired, people are allowed to pass pins 54 through the through holes 110 of the support posts 11 such that the polyurethane pads 53 will come into contact with the pins 54, and the movable expanding assemblies 50 will be prevented from sliding down to cause accidents. In addition, the support posts 11 of the frame 1 each have a holding cavity 111 on a lower end thereof; thus, the operators are allowed to insert and locate the pins 54 in the holding cavities 111 before using the shrink film machine.

Figure 10:
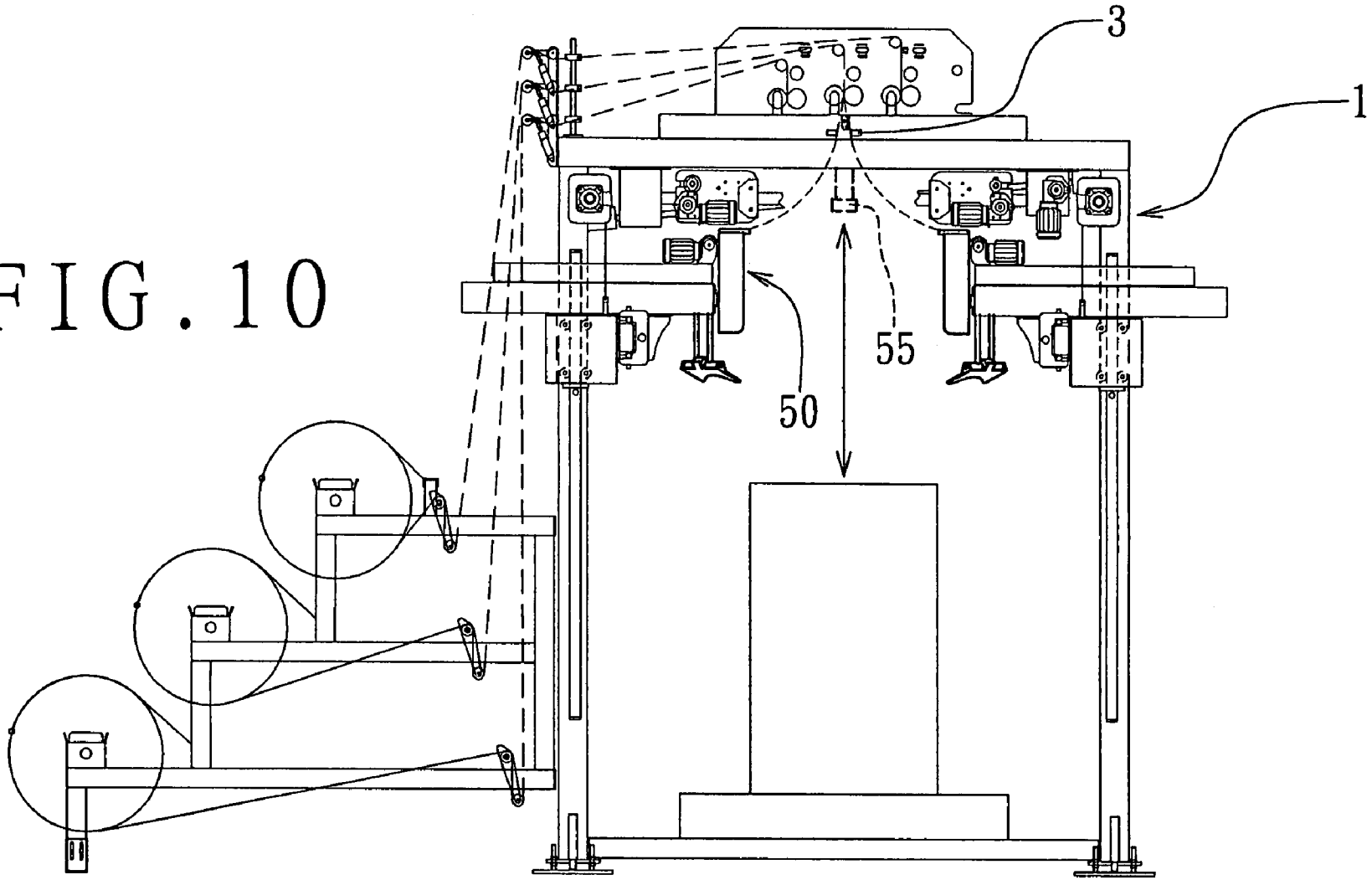
FIG. 10 is a side view of the present invention taken when the ultrasonic sensor is functioning.
Figure 11:
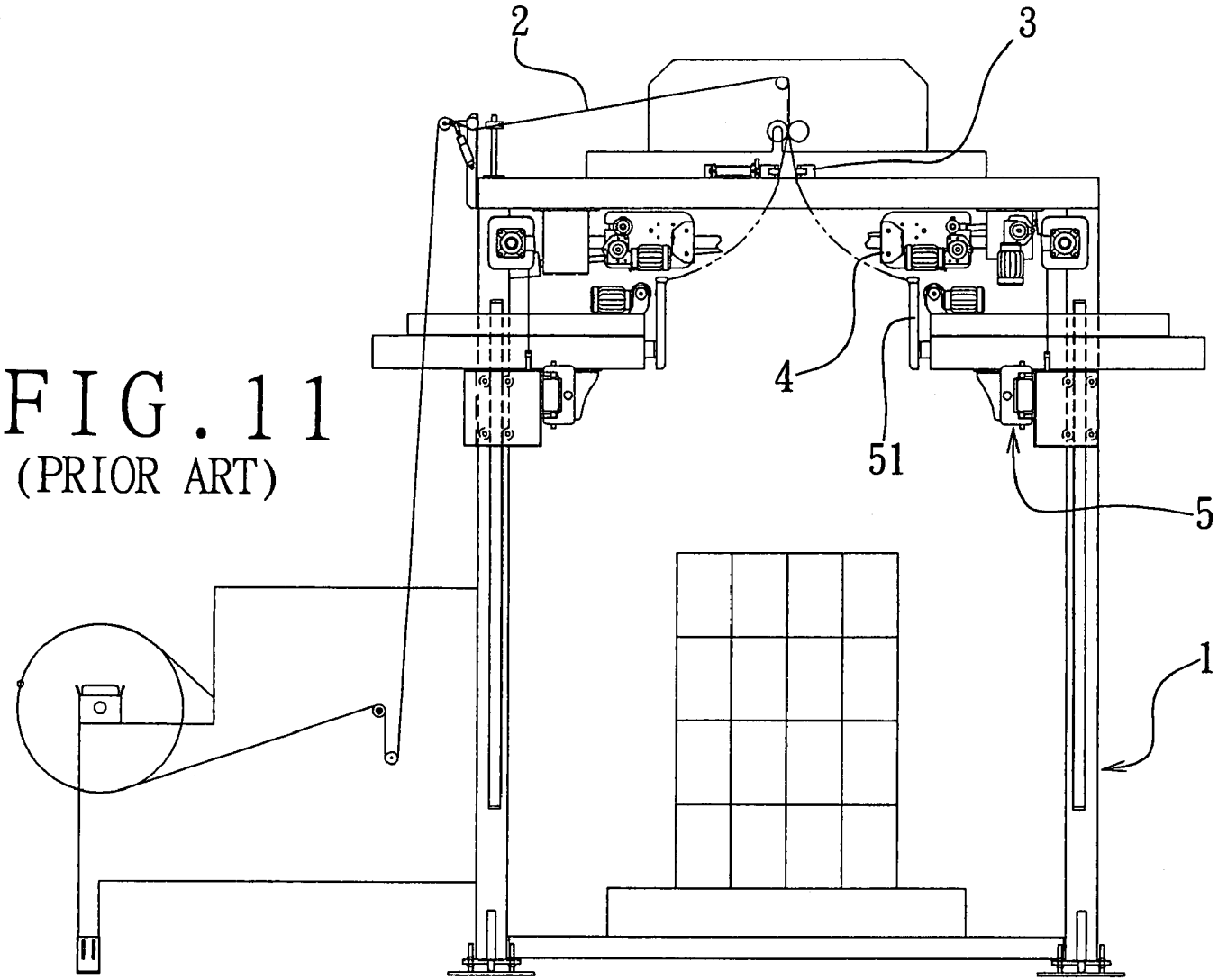
FIG. 11 (PRIOR ART)
FIG. 11 is a view of the currently available shrink film machine.

Furthermore, referring to FIG. 10, the ultrasonic sensor 55 is joined to the bag sealing device 3, and faces the goods to be wrapped with the shrink film for measuring the height of the goods. The measurement obtained with the ultrasonic sensor 55 will be transferred to the control system of the machine. Therefore, the sealing and cutting action will be started immediately after the shrink film is lowered with the movable expanding assemblies 50 to such a position as to encompass the goods, thus increasing smoothness and precision of the machine's operation.

From the above description, it can be easily seen that the shrink film machine of the present invention has the following advantages:

1. The machine is equipped with the detecting device; the shading block of the detecting device will shade the sensor under normal conditions; if the goods are tilted or improperly positioned, the stopping boards will come into contact with the goods, and pivot to a tilting position. Therefore, the shading block will no longer shade the sensor. Consequently, the control system makes the bag expanding device and the other mechanisms of the machine stop in order to avoid damage to the goods and the machine.

2. The machine is equipped with the ultrasonic sensor for measuring the height of the goods; the measurement will be transferred to the control system of the machine. Therefore, the sealing and cutting action will be started immediately after the shrink film is lowered with the movable expanding assemblies to such a position as to encompass the goods, thus increasing smoothness of the machine's operation.

3. Because the machine has the polyurethane pads on lower sides of the movable expanding assemblies, the pins, and the through holes of the support posts of the frame, the operators are allowed to prevent the movable expanding assemblies from sliding down to cause accidents when the machine isn't in use or when the machine needs repair.

What is claimed is:

1. A detecting and protecting device of a shrink film machine, comprising a plurality of detecting devices connected to respective ones of plural movable expanding assemblies of a bag expanding device of a shrink film machine, each of which movable expanding assemblies includes a supporting rods for shrink films; the detecting devices being positioned below the supporting rods; each of the detecting devices including:

a support seat positioned behind a corresponding supporting rod;

a movable rod passed through the support seat and projecting below the corresponding supporting rod;

a stopping board pivoted to one end of the movable rod;

a shading block joined to one end of the stopping board; and a sensor positioned on a portion of the movable rod that is faced with the shading block of the stopping board; the sensor being normally shaded by the shading block; when the stopping board comes into contact with goods to be wrapped in a shrink film during a course of the movable expanding assemblies moving downwards to place the shrink film around the goods, the stopping board will pivot to a tilting position, and the shading block will no longer shade the sensor.

2. The detecting and protecting device of a shrink film machine as claimed in claim 1, wherein the movable expanding assemblies of the bag expanding device each have a polyurethane pad on a lower side thereof, and a frame of the machine includes plural support posts, each of which has a through hole; thus, when pins are passed through the through holes of the support posts of the frame, the movable expanding assemblies will be prevented from sliding down with the polyurethane pads coming into contact with the pins.

3. The detecting and protecting device of a shrink film machine as claimed in claim 2, wherein the support posts of the frame each have a holding cavity on a lower end thereof for storing the pins therein.

* * * * *